US007802992B2

(12) United States Patent
Niitsu et al.

(10) Patent No.: US 7,802,992 B2
(45) Date of Patent: Sep. 28, 2010

(54) ROTARY CONNECTOR

(75) Inventors: Toshihiro Niitsu, Machida (JP); Shigeyuki Hoshikawa, Kanagawa (JP); Kimiyasu Makino, Kanagawa (JP)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 12/085,105

(22) PCT Filed: Nov. 15, 2006

(86) PCT No.: PCT/US2006/060905

§ 371 (c)(1),
(2), (4) Date: Jun. 12, 2009

(87) PCT Pub. No.: WO2007/059502

PCT Pub. Date: May 24, 2007

(65) Prior Publication Data

US 2009/0246976 A1 Oct. 1, 2009

(51) Int. Cl.
*H01R 39/00* (2006.01)

(52) U.S. Cl. ..... 439/19

(58) Field of Classification Search ..... 439/19, 439/17

See application file for complete search history.

(56) References Cited

U.S. PATENT DOCUMENTS 5,358,460 A 10/1994 Vranish
5,829,986 A * 11/1998 Kong ..... 439/13
5,923,114 A * 7/1999 Senni ..... 310/232
6,612,847 B2 * 9/2003 Canizales, Jr. ..... 439/17

FOREIGN PATENT DOCUMENTS

| | | |
|---|---|---|
| CH | 569357 | 11/1975 |
| DE | 102 16 855 | 11/2003 |
| FR | 2770042 | 4/1999 |
| JP | 1988-062454 | 11/1989 |
| JP | 1991-086469 | 8/1992 |
| JP | 1991-265508 | 4/1993 |

OTHER PUBLICATIONS

International Search Report for PCT/US06/060905.

* cited by examiner

*Primary Examiner*—Gary F. Paumen
(74) *Attorney, Agent, or Firm*—Timothy M. Morella

(57) ABSTRACT

Rotary electrical connector comprising a ring-shaped outside terminal having a circular inner circumference portion, a ring-shaped inside terminal having a circular outer circumference portion, which is concentric with the inner circumference portion of the ring-shaped outside terminal; and a rotatable ring-shaped connection terminal electrically connecting the outside terminal with the inside terminal; wherein the connection terminal elastically deforms along a radial direction thereof, an outer circumference portion of the connection terminal abutting the inner circumference portion of the outside terminal and the outer circumference portion of the inside terminal.

5 Claims, 10 Drawing Sheets

(Prior art)

ROTARY CONNECTOR

BACKGROUND OF THE INVENTION

1. Field of the Invention

The present invention relates to a rotary connector.

2. Description of the Related Art

Conventionally, a rotary connector is used for electrically connecting power lines, signal lines, and the like, between two relatively rotating members (for example, see Japanese Patent Application Laid-Open (kokai) No. H5-82223). This kind of rotary connector can maintain electrical connection irrespective of a relative rotation angle of the rotating members.

FIG. 13 is a plain view of the main part of a conventional rotary connector.

In FIG. 13, a reference numeral 301 designates an inner ring made of electrically conductive metal, which is connected to a wire extending from one member on which the rotary connector is mounted. Also, a reference numeral 302 designates an outer ring made of electrically conductive metal, which is connected to a wire extending from the other member on which the rotary connector is mounted. In this case, the inner ring 301 and the outer ring 302 are positioned to form concentric circles, and the one member and the other member relatively rotate around the central axis of the inner ring 301 and the outer ring 302.

Also, a circular retainer 303 is rotatably placed relative to the inner ring 301 and the outer ring 302 between the inner ring 301 and the outer ring 302. Wheels 304 made of electrically conductive metal are mounted in the retainer 303. The wheels 304 are rotatably mounted relative to the retainer 303 at three points in the retainer through mounting shafts 305.

The wheels 304 roll along the outer circumference surface of the inner ring 301 and the inner circumference surface of the outer ring 302 when the inner ring 301 and the outer ring 302 relatively rotate. Thereby, the wheels 304 can electrically connect the relatively rotating inner ring 301 and outer ring 302 irrespective of the rotation angle therebetween.

However, since the wheels 304 in the conventional rotary connector are rigid and do not deform in the radial direction thereof, electrical connection can be momentarily broken between the inner ring 301 and the outer ring 302. Theoretically speaking, the inner ring 301 and the outer ring 302 are always electrically connected through the wheels 304, if the wheels, which have a diameter equal to a difference between the radius of the outer circumference of the inner ring 301 and the radius of the inner circumference of the outer ring 302, are rotatably placed in equally-spaced three points between the outer circumference of the inner ring 301 and the inner circumference of the outer ring 302. However, in practice, dimensional errors in manufacturing and assembling the inner ring 301, the outer ring 302, and the wheels 304 causes backlash between the inner ring 301, the outer ring 302, and the wheels 304. This causes all the wheels 304 to be separated, even though momentarily, from the outer circumference surface of the inner ring 301 or the inner circumference surface of the outer ring 302, and thus may result in electrical disconnection in some cases.

Therefore, in order to provide higher reliability in electrical connection, Japanese Patent Application Laid-open (kokai) No. H5-82223 discloses a rotary connector, in which flange portions in the outermost circumferences of each of the wheels 304 slidingly contact the side surfaces of both the inner ring 301 and the outer ring 302 in such a way as to hold the side surfaces thereof between the flange portions. However, since the flange portions of each of the wheels 304 slidingly contact the side surfaces of the inner ring 301 and the outer ring 302 on both sides thereof, substantial resistance occurs to relative rotation of the inner ring 301 and the outer ring 302. Moreover, it causes wear of the flange portions of the wheels 304 or of the side surfaces of the inner ring 301 and the outer ring 302, and thus bad electrical contact occurs after long-term use.

SUMMARY OF THE INVENTION

The present invention has been made with a view to solving the above problems of the conventional rotary connectors. It is therefore an object of the present invention to provide a simply-structured, low-cost, and widely applicable rotary connector, which is highly reliable in electrical connection since it is free from electrical disconnection, even if momentarily, between the ring-shaped inside terminal and the ring-shaped outside terminal through a ring-shaped connection terminal by allowing the ring-shaped connection terminal, which abuts the outer circumference portion of a ring-shaped inside terminal and the inner circumference portion of a ring-shaped outside terminal, to deform elastically along the radial direction so as to absorb errors in the members.

In order to achieve the above object, the present invention provides a rotary connector for electrically connecting wires of two relatively rotating connection target members, including: a ring-shaped outside terminal having a circular inner circumference portion and connected to the wire of one connection target member; a ring-shaped inside terminal having a circular outer circumference portion, which is concentric with the inner circumference portion of the ring-shaped outside terminal, and connected to the wire of the other connection target member; and a rotatable ring-shaped connection terminal electrically connecting the ring-shaped outside terminal and the ring-shaped inside terminal, wherein the ring-shaped connection terminal elastically deforms along a radial direction thereof, and an outer circumference portion of the ring-shaped connection terminal abuts the inner circumference portion of the ring-shaped outside terminal and the outer circumference portion of the ring-shaped inside terminal.

Preferably, the ring-shaped connection terminal rolls around the inner circumference of the ring-shaped outside terminal and the outer circumference of the ring-shaped inside terminal while elastically deforming along the radial direction of the ring-shaped connection terminal, when the ring-shaped outside terminal and the ring-shaped inside terminal relatively rotate.

Preferably, the ring-shaped connection terminal is mounted rotatably around a rod-like bearing member extending parallel to an axis of the ring-shaped outside terminal and the ring-shaped inside terminal and so as to be elastically deformable along the radial direction of the ring-shaped connection terminal.

Preferably, the ring-shaped connection terminal is positioned along the axial direction by insulators alternately superimposed on the ring-shaped outside terminal and the ring-shaped inside terminal.

Preferably, the ring-shaped outside terminal is superimposed alternately on the ring-shaped outside insulator having an inner circumference portion smaller in diameter than the inner circumference portion of the ring-shaped outside terminal, the ring-shaped inside terminal is superimposed alternately on the ring-shaped inside insulator having an outer circumference portion larger in diameter than the outer circumference portion of the ring-shaped inside terminal, and the ring-shaped connection terminal is positioned along the axial direction by the ring-shaped outside insulator and the ring-shaped inside insulator.

Preferably, the ring-shaped outside terminal and the ring-shaped inside terminal are superimposed alternately on the ring-shaped intermediate insulator having an outer circumference portion larger in diameter than the inner circumference portion of the ring-shaped outside terminal, an inner circumference portion smaller in diameter than the outer circumference portion of the ring-shaped inside terminal, and openings for inserting the rod-like bearing members, and the ring-shaped connection terminal is supported by an edge of the opening, and positioned by the ring-shaped intermediate insulator along the axial direction.

According to the present invention, the rotary connector has a ring-shaped connection terminal, which abuts the outer circumference portion of the ring-shaped inside terminal and the inner circumference portion of the ring-shaped outside terminal, are elastically deformable along the radial direction. Thereby, errors in the members can be absorbed, and it is therefore possible to achieve a simply-structured, low-cost, and widely applicable rotary connector, which is highly reliable in electrical connection since it is free from electrical disconnection, even if momentarily, between the ring-shaped inside terminal and the ring-shaped outside terminal through the ring-shaped connection terminal.

DESCRIPTION OF THE PREFERRED EMBODIMENTS

An embodiment of the present invention is described below in detail with reference to the accompanying drawings.

Figure 1:
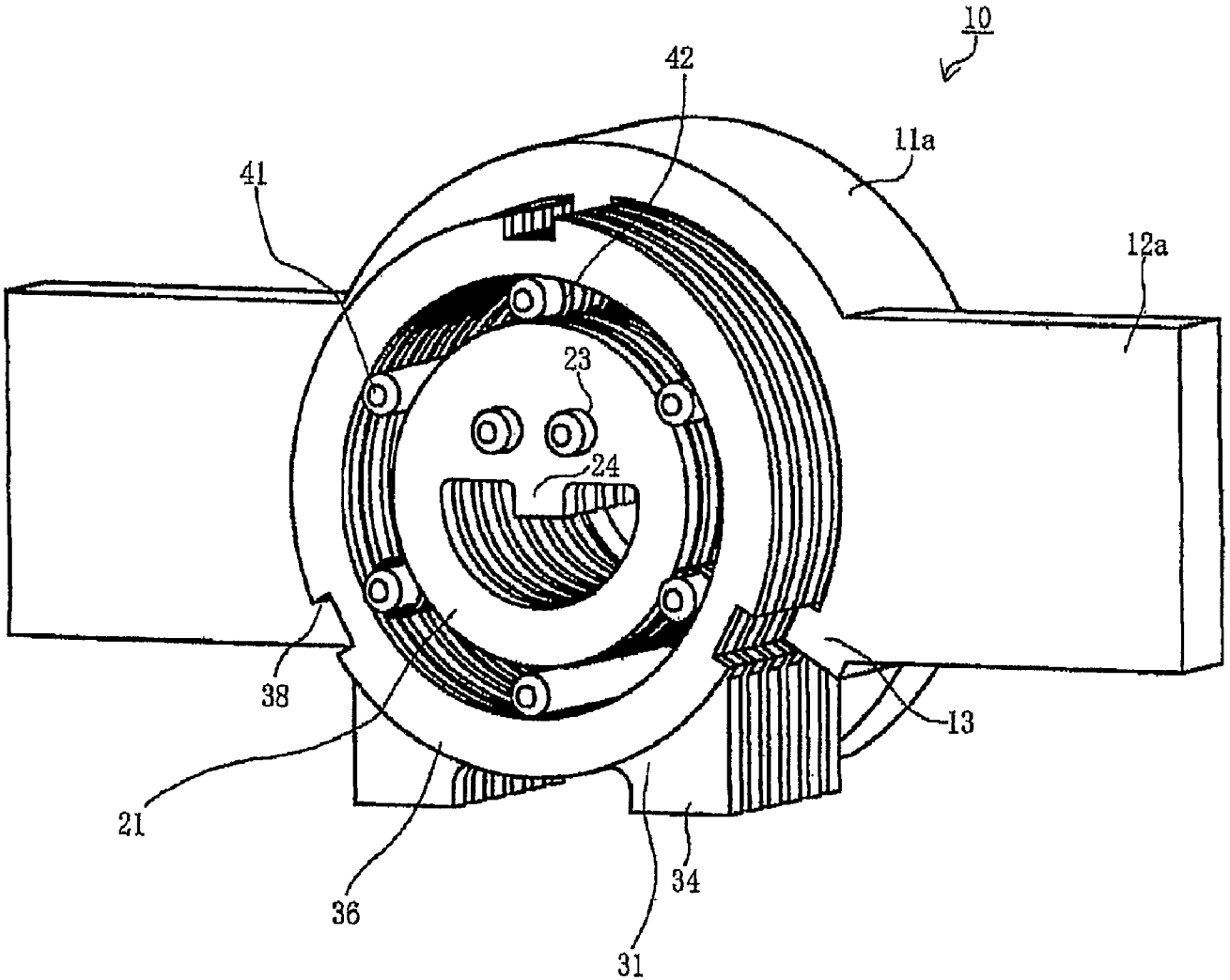
FIG. 1 is a perspective view showing the inside of a rotary connector according to an embodiment of the present invention.
Figure 2:
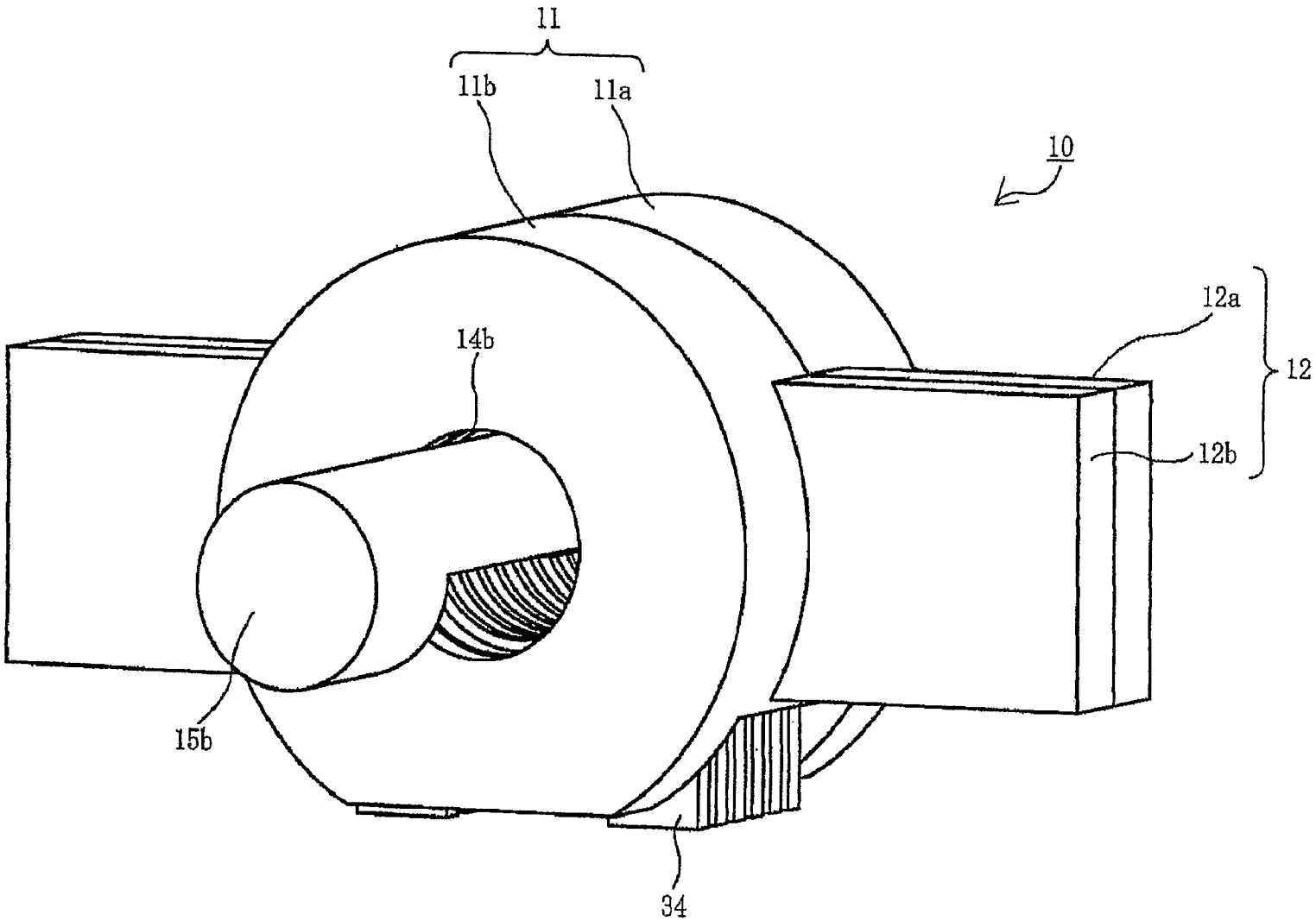
FIG. 2 is a perspective view of the rotary connector according to the embodiment of the present invention.
Figure 3:
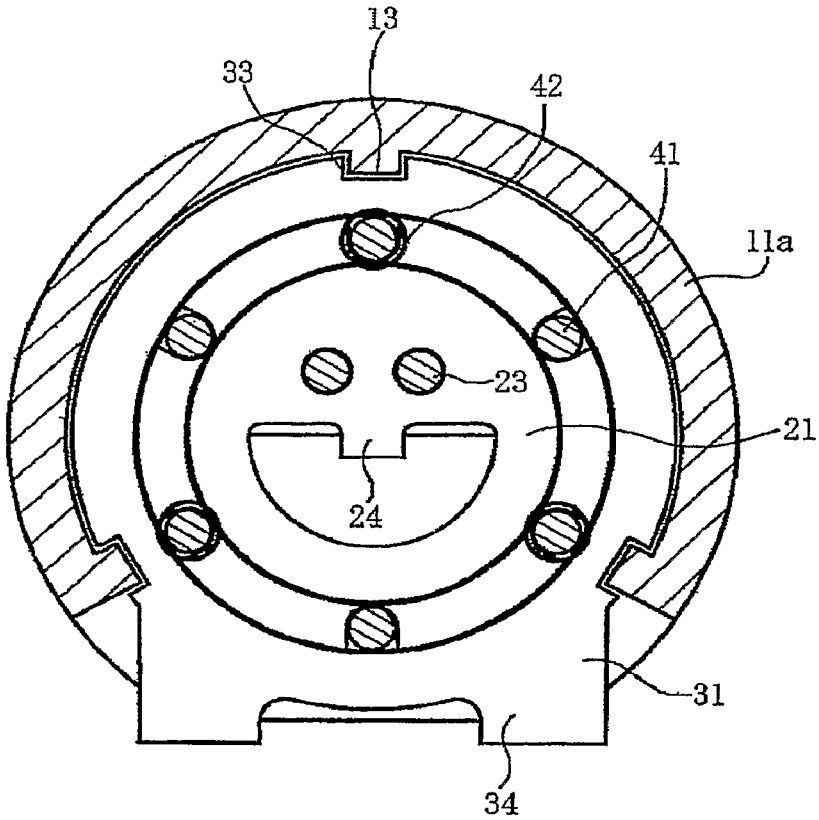
FIG. 3 is a transverse sectional view of the rotary connector according to the embodiment of the present invention.
Figure 4:
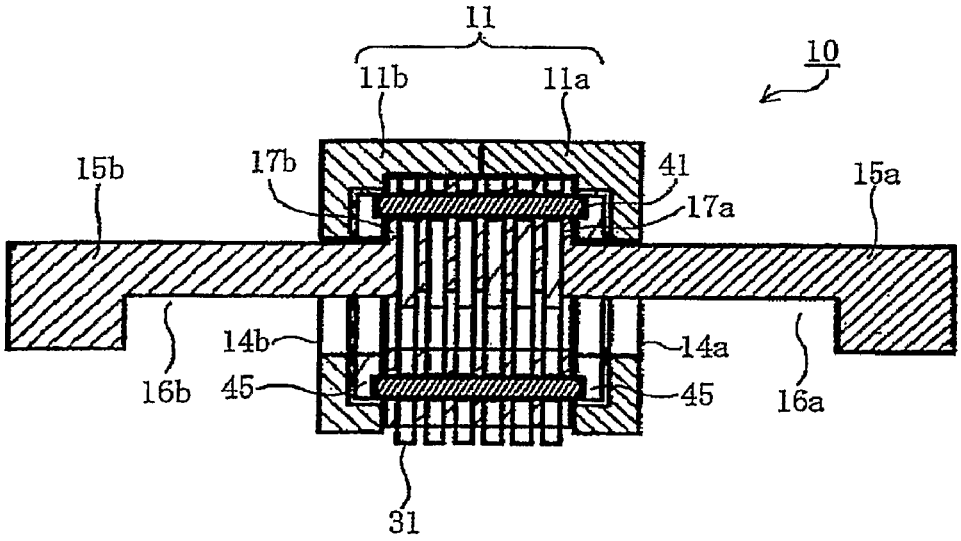
FIG. 4 is a sectional side view of the rotary connector according to the embodiment of the present invention.
Figure 5:
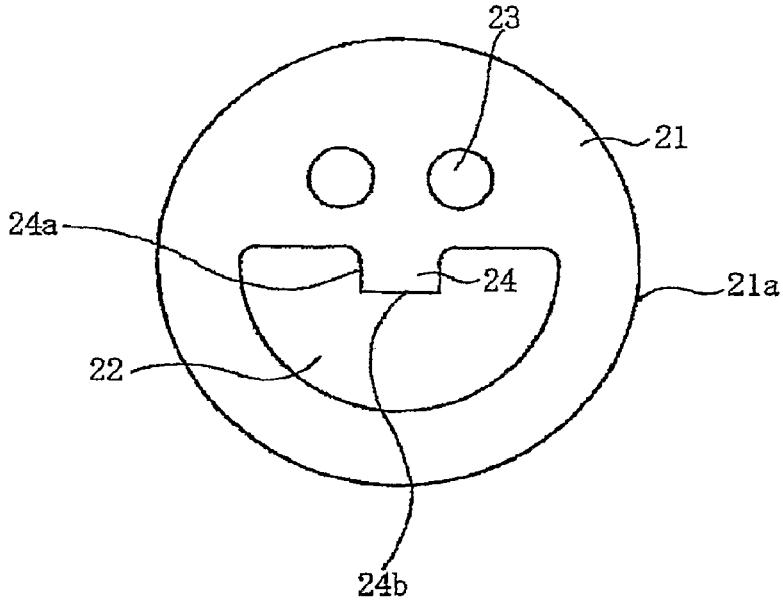
FIG. 5 is a plan view of a ring-shaped inside terminal of the rotary connector according to the embodiment of the present invention.
Figure 6:
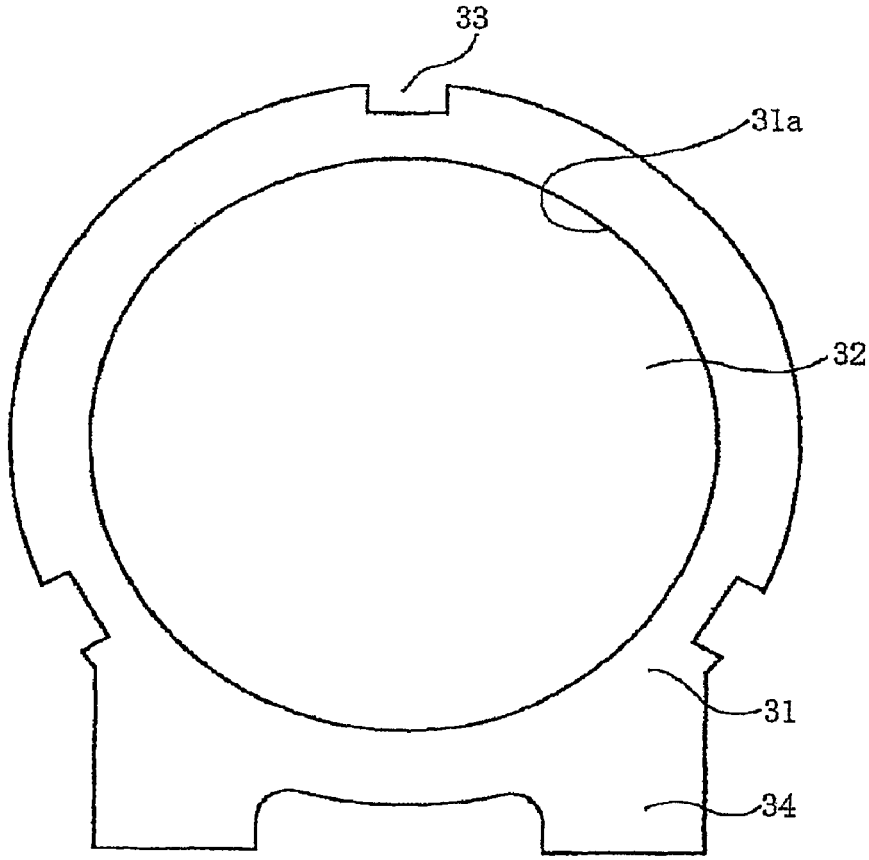
FIG. 6 is a plan view of a ring-shaped outside terminal of the rotary connector according to the embodiment of the present invention.
Figure 7:
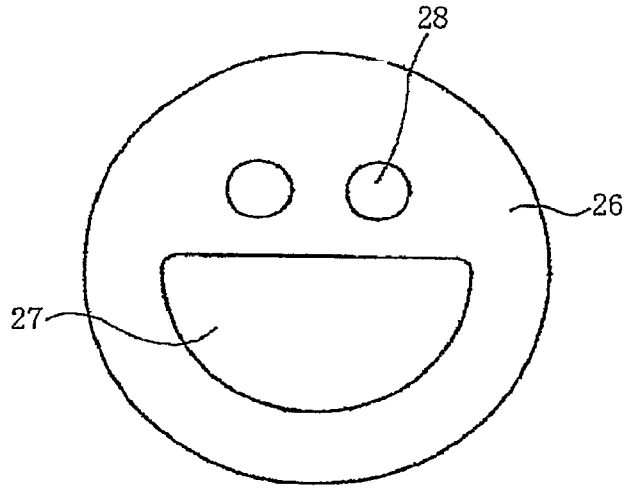
FIG. 7 is a plan view of a ring-shaped inside insulator of the rotary connector according to the embodiment of the present invention.
Figure 8:
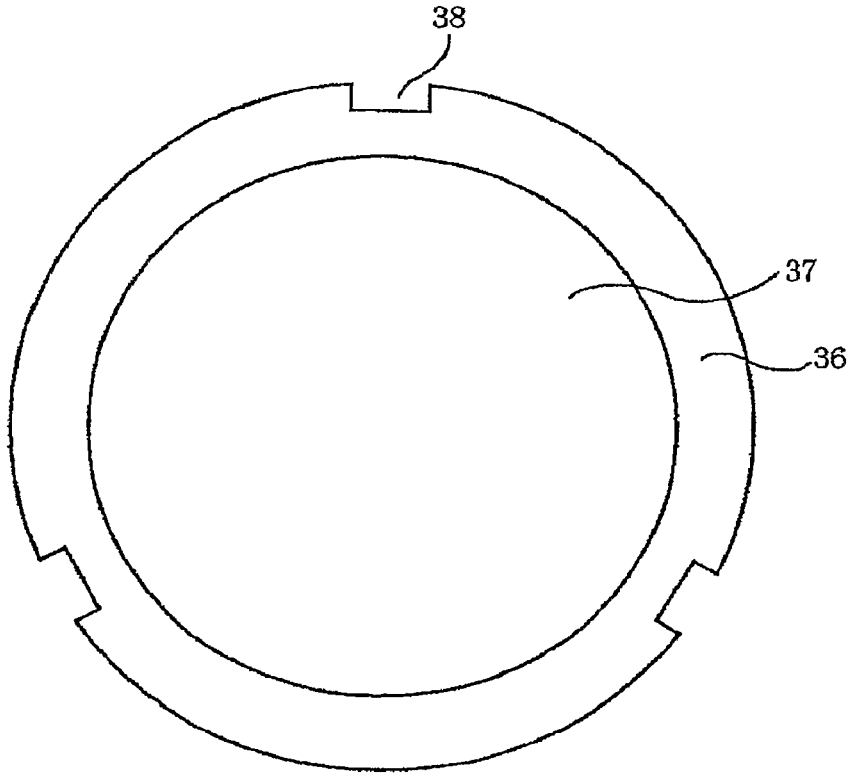
FIG. 8 is a plan view of a ring-shaped outside insulator of the rotary connector according to the embodiment of the present invention.

FIG. 1 is a perspective view showing the inside of a rotary connector according to the embodiment of the present invention, FIG. 2 is a perspective view of the rotary connector according to the embodiment of the present invention, FIG. 3 is a transverse sectional view of the rotary connector according to the embodiment of the present invention, FIG. 4 is a sectional side view of the rotary connector according to the embodiment of the present invention, FIG. 5 is a plan view of a ring-shaped inside terminal of the rotary connector according to the embodiment of the present invention, FIG. 6 is a plan view of a ring-shaped outside terminal of the rotary connector according to the embodiment of the present invention, FIG. 7 is a plan view of a ring-shaped inside insulator of the rotary connector according to the embodiment of the present invention, and FIG. 8 is a plan view of a ring-shaped outside insulator of the rotary connector according to the embodiment of the present invention.

In the figures, reference numeral 10 designates the rotary connector, according to the embodiment, for use in electrically connecting wires, such as a power line, a signal line, and the like, of relatively rotating connection target members. The relatively rotating connection target members can be members of any kind of apparatus, and of any size. For example, the relatively rotating members can be a body part or a display part of a small electrical device such as a mobile phone, personal computer, PDA (Personal Digital Assistant), digital camera, video camera, music player, mobile game machine and the like, wherein the body part or the display part is rotatably linked by a hinge member and the like. Further, the relatively rotating members can be a steering wheel and a steering column rotatably supporting the steering wheel. Further, the relatively rotating members can be a rotating member of a large apparatus such as an assembly robot or a machine tool, and the like, and a supporting member thereof.

In this embodiment, representations of directions such as "up", "down", "left", "right", "front", "rear", and the like, used for explaining a structure and movement of each part of the rotary connector 10, are not absolute, but relative. These representations are appropriate when the rotary connecter 10 is in the position shown in the figures. If the position of the rotary connector 10 changes, however, it is assumed that these representations are to be changed according to the change of the position of the rotary connector 10.

As shown in FIG. 2, the rotary connector 10 has a cover 11 which is formed of insulating material such as synthetic resin and is to be mounted on one connection target member. The cover 11 is almost cylindrical in shape, and has a wing-like mounting part 12 extending outwards from two sides of the axial center of the rotary connector 10. The mounting part 12 is for use in mounting the cover 11 on the one connection target member, and a shape or location of the mounting part 12 may be changed as necessary or the mounting part 12 may be even omitted. Both the cover 11 and the mounting part 12 can be divided into front and rear parts perpendicularly to the axis of the rotary connector 10 at the center thereof. The cover 11 is made up of a front cover 11*b* and a rear cover 11*a*, and the mounting part 12 is made up of a front mounting part 12*b* and a rear mounting part 12*a*.

As shown in FIG. 1, the rotary connector 10 has a plurality of ring-shaped outside terminals 31, which are placed inside the cover 11. The ring-shaped outside terminal 31 has the circular inner circumference surface as the inner circumference portion, and connection legs 34 projecting downwards from the lower parts of the cover 11. The lower ends of the connection legs 34 are connected to a connection pad formed on a surface of a circuit substrate and the like, not shown, included in the one connection target member by using connection means such as soldering and the like. The ring-shaped outside terminals 31 are thereby electrically connected to wires of the circuit substrate and the like included in the one connection target member.

Also, as shown in FIG. 2 and FIG. 4, the rotary connector 10 has a front shaft 15*b* and a rear shaft 15*a*, which are formed of insulating material such as synthetic resin and are mounted on the other connection target member. The front shaft 15*b* and the rear shaft 15*a* are placed so that the front shaft 15*b* projects forward from an opening 14*b* in the front cover 11*b* and the rear shaft 15*a* projects backward from an opening 14*a* in the rear cover 11*a*.

Moreover, as shown in FIG. 1, the rotary connector 10 includes a plurality of ring-shaped inside terminals 21 rotatably mounted inside the ring-shaped outside terminals 31 on the inner side of the cover 11. Each ring-shaped inside terminal 21 has a circular outer circumference surface as the outer circumference portion and is disposed so that the circular outer circumference surface is concentric with the circular inner circumference surface of each ring-shaped outside terminal 31. The front shaft 15*b* and the rear shaft 15*a* have a front flange 17*b* and a rear flange 17*a* respectively, and the front flange 17*b* and the rear flange 17*a* are mounted so as to rotate with the ring-shaped inside terminals 21. Further, the front shaft 15*b* and the rear shaft 15*a* have a front concave portion 16*b* and a rear concave portion 16*a*, respectively, for housing a circuit substrate and the like (not shown) of the other connection target member. The end of a connection leg 24 of the ring-shaped inside terminal 21 is connected, by using connection means such as soldering, to the connection pad formed on the surface of the circuit substrate and the like housed in the front concave portion 16*b* and the rear concave portion 16*a*. The ring-shaped inside terminals 21 are thereby electrically connected to wires of the circuit substrate and the like, included in the other connection target member. Hereinafter, the front shaft 15*b* and the rear shaft 15*a* are referred to as a shaft 15 for explaining in an integrated manner. The same applies to the front concave portion 16*b* and the rear concave portion 16*a*, referred to as a concave portion 16, and the front flange 17*b* and the rear flange 17*a*, referred to as a flange 17.

As shown in FIG. 6, the ring-shaped outside terminal 31 is made of an electrically conductive annular metal plate having a circular hole 32 in the center thereof. The circumference surface of the hole 32 corresponds to the inner circumference surface of the ring-shaped outside terminal 31. The ring-shaped outside terminal 31 has two connection legs 34 projecting downwards as shown in the figure. The number of legs 34 may be arbitrarily changed, and may be one, or more than two. Further, three engagement concave portions 33 are formed in the outer circumference surface of the ring-shaped outside terminal 31. As shown in FIG. 3, when the ring-shaped outside terminals 31 are mounted inside the rear cover 11*a*, the engagement concave portions 33 engage with engagement convex portions 13 projecting from the inner circumference surface of the rear cover 11*a* so as to prevent rotation of the ring-shaped outside terminals 31 relative to the rear cover 11*a*. That is, the engagement concave portions 33 and the engagement convex portions 13 serve as a rotation stopper of the ring-shaped outside terminals 31. The number and location of the engagement concave portions 33 and the engagement convex portions 13 may be arbitrarily set. Further, the front cover 11*b* also has engagement convex portions (not shown) similar to the engagement convex portions 13.

As shown in FIG. 1, a plurality of the ring-shaped outside terminals 31 are placed inside the cover 11 in a state of being superimposed on each other. At this point, a ring-shaped outside insulator 36 is placed between each pair of neighboring ring-shaped outside terminals 31 to prevent electrical conduction between the neighboring ring-shaped outside terminals 31. The ring-shaped outside insulator 36 is made of insulating material. As shown in FIG. 8, the ring-shaped outside insulator 36 is an annular plate member having a circular hole 37 in the center thereof, with engagement concave portions 38 in the outer circumference surface thereof. The size and location of the engagement concave portions 38 are the same as the size and location of the engagement concave portions 33 of the ring-shaped outside terminals 31. The engagement concave portions 38 engage with the engagement convex portions 13 of the rear cover 11*a* and the engagement convex portions of the front cover 11*b* to prevent rotation of the ring-shaped outside insulators 36.

The outside diameter of the ring-shaped outside insulator 36 is equal to the outside diameter of the ring-shaped outside terminal 31, and the inside diameter of the ring-shaped outside insulator 36 is slightly smaller than the inside diameter of the ring-shaped outside terminal 31. Specifically, the diameter of the hole 37 of the ring-shaped outside insulator 36 is slightly smaller than the diameter of the hole 32 of the ring-shaped outside terminal 31. Therefore, as shown in FIG. 1, with the ring-shaped outside terminals 31 and the ring-shaped outside insulators 36 alternately superimposed on each other, the inner circumference edges of the ring-shaped outside insulators 36 project slightly inwards from the inner circumference edges of the ring-shaped outside terminals 31, thereby lying on both sides of the ring-shaped connection terminals 42 abutting the inner circumference surfaces of the ring-shaped outside terminals 31 so as to restrict the movement of the ring-shaped connection terminals 42 in the axial direction of the rotary connector 10. In other words, the ring-shaped outside insulators 36 serve as positioning members for positioning the ring-shaped connection terminals 42 in the axial direction of the rotary connector 10.

As shown in FIG. 5, the ring-shaped inside terminal 21 is made of an electrically conductive circular metal plate, which has a semicircular hole 22 in the center thereof, including a connection leg 24 projecting downwards as shown in FIG. 5 in the hole 22. The connection leg 24 has a projecting portion 24*a* and a connecting end portion 24*b*, wherein the connecting end portion 24*b* connects to a connection pad of a circuit substrate placed in the hole 22. As mentioned previously, the circuit substrate is housed in the front concave portion 16*b* and the rear concave portion 16*a*, and therefrom connected to a circuit as a connection target. In this way, a circuit from the ring-shaped inside terminal 21 to a connection target can be formed with a relatively simple structure. The number of connection legs 24 may be arbitrarily set, and may be more than one. Further, two circular engagement holes 23 are formed in the ring-shaped inside terminal 21, wherein the circular engagement holes 23 are in the opposite side of the hole 22. As shown in FIG. 1 and FIG. 3, shaft bearings 41, as cylindrical rod bearings each made of insulating material, are inserted into the engagement holes 23 to engage with the engagement holes 23. Each shaft bearing 41 extends along the axial direction of the rotary connector 10, and the two ends of the shaft bearing 41 are engaged with the front flange 17*b* of the front shaft 15*b* and the rear flange 17*a* of the rear shaft 15*a*. Therefore, the ring-shaped inside terminals 21 rotate with the front shaft 15*b* and the rear shaft 15*a*.

As shown in FIG. 1, a plurality of the ring-shaped inside terminals 21 are placed inside the cover 11 in a state of being superimposed on each other in a cylindrical space formed by the holes 32 of the ring-shaped outside terminals 31 and the holes 37 of the ring-shaped outside insulators 36. In this instance, a ring-shaped inside insulator 26 is placed between neighboring ring-shaped inside terminals 21 to prevent electrical conduction between neighboring ring-shaped inside terminals 21. The ring-shaped inside insulator 26 is made of insulating material. As shown in FIG. 7, it is a annular plate member having a semicircular hole 27 in the center thereof and circular engagement holes 28 are formed in the opposite side of the hole 27 in the ring-shaped inside insulator 26. The size and location of engagement holes 28 are the same as the size and location of the engagement holes 23 of the ring-shaped inside terminal 21, and the shaft bearings 41 are inserted to engage with the engagement holes 28. The ring-shaped inside insulators 26, thereby, rotate with the front shaft 15*b* and the rear shaft 15*a* in a state of being alternately superimposed on the ring-shaped inside terminals 21.

The outside diameter of the ring-shaped inside insulator 26 is formed slightly larger than the outside diameter of the ring-shaped inside terminal 21. Further, the diameter of the hole 37 in the ring-shaped outside insulator 36 is slightly smaller than the diameter of the hole 32 in the ring-shaped outside terminal 31. Therefore, as shown in FIG. 1, with the ring-shaped inside terminals 21 and the ring-shaped inside insulators 26 alternately superimposed on each other, the outer circumference edges of the ring-shaped inside insulators 26 project slightly outwards from the outer circumference edges of the ring-shaped inside terminals 21, thereby lying on both sides of the ring-shaped connection terminals 42 abutting the outer circumference surfaces of the ring-shaped inside terminals 21 so as to restrict the movement of the ring-shaped connection terminals 42 in the axial direction of the rotary connector 10. In other words, the ring-shaped inside insulators 26 serve as positioning members for positioning the ring-shaped connection terminals 42 in the axial direction of the rotary connector 10.

In the state where the ring-shaped outside terminals 31, the ring-shaped outside insulators 36, the ring-shaped inside terminals 21 and the ring-shaped inside insulators 26 are placed inside the cover 11, the locations of the ring-shaped outside terminals 31 and the ring-shaped inside terminals 21 correspond to each other, and also the locations of the ring-shaped outside insulators 36 and the ring-shaped inside insulators 26 correspond to each other, with respect to the axial direction of the rotary connector 10. Specifically, the ring-shaped outside terminals 31 and the ring-shaped inside terminals 21 face each other, and also the ring-shaped outside insulators 36 and the ring-shaped inside insulators 26 face each other. Then, the ring-shaped connection terminals 42 are placed between the ring-shaped outside terminals 31 and the ring-shaped inside terminals 21, which are facing each other.

Each ring-shaped connection terminal 42 is a ring-shaped member made of elastic, electrically conductive metal, and can deform elastically in the radial direction of the ring-shaped connection terminal 42. That is, if the ring-shaped connection terminal 42 is subjected to external force along the radial direction thereof, the ring-shaped connection terminal 42 deforms along the radial direction, and goes back to its original shape when the external force ceases. Therefore, preferably the ring-shaped connection terminal 42 is thin in the radial thickness and is a seamless ring. For example, the ring-shaped connection terminal 42 could be manufactured by slicing a thin-walled seamless metal pipe. For example, when the rotary connector 10 is used in a small electronic device such as a mobile telephone, the outside diameter of the ring-shaped connection terminal 42 would be in the order of 0.5 mm and the radial thickness thereof would be in the order of 0.01 mm. This sort of metal pipe or a metal ring small in diameter and thin-walled can be made by, for example, electroforming.

For example, if the ring-shaped connection terminal 42 is a pipe-shaped connection terminal, the pipe-shaped connection terminal is placed so that the outer circumference surface of the pipe-shaped connection terminal abuts the inner circumference surface of the ring-shaped outside terminal 31 and the outer circumference surface of the ring-shaped inside terminal 21. In this case, the outside diameter of the ring-shaped connection terminal 42 is set larger than the gap between the inner circumference surface of the ring-shaped outside terminal 31 and the outer circumference surface of the ring-shaped inside terminal 21. Specifically, the outside diameter of the ring-shaped connection terminal 42 is set larger than one-half of the difference between the inside diameter of the hole 32 of the ring-shaped outside terminal 31 and the outside diameter of the ring-shaped inside terminal 21. Therefore, the ring-shaped connection terminal 42 is subjected to external force, along the radial direction thereof, from the inner circumference surface of the ring-shaped outside terminal 31 and the outer circumference surface of the ring-shaped inside terminal 21, thereby deforming along the radial direction. Then, when the ring-shaped outside terminal 31 and the ring-shaped inside terminal 21 rotate relatively, the ring-shaped connection terminals 42 roll between the inner circumference surface of the ring-shaped outside terminal 31 and the outer circumference surface of the ring-shaped inside terminal 21.

If the gap between the inner circumference surface of the ring-shaped outside terminal 31 and the outer circumference surface of the ring-shaped inside terminal 21 becomes smaller than a reference value, the deformation of the ring-shaped connection terminal 42 becomes larger, and thus abutment between the inner circumference surface of the ring-shaped outside terminal 31 and the outer circumference surface of the ring-shaped inside terminal 21 is maintained. On the other hand, if the gap becomes larger than the reference value, the deformation of the ring-shaped connection terminal 42 becomes smaller, and still abutment between the inner circumference surface of the ring-shaped outside terminal 31 and the outer circumference surface of the ring-shaped inside terminal 21 is maintained. Thus, since the ring-shaped connection terminal 42 can elastically deform along the radial direction thereof, electrical connection between the ring-shaped outside terminal 31 and the ring-shaped inside terminal 21 via the ring-shaped connection terminal 42 can be maintained without fail even if there is a change in the gap between the inner circumference surface of the ring-shaped outside terminal 31 and the outer circumference surface of the ring-shaped inside terminal 21.

Further, a plurality of, for example, six shaft bearings 41 are placed at even intervals between the inner circumference surface of the ring-shaped outside terminal 31 and the outer circumference surface of the ring-shaped inside terminal 21. As shown in FIG. 4, the both ends of each shaft bearing 41 are placed into ring-shaped bearing sleeves 45, which are mounted inside the front cover 11*b* and the rear cover 11*a*. Thereby, a fixed distance between the shaft bearings 41 is maintained. Also, the ring-shaped connection terminals 42 are loosely placed around some, for example, three shaft bearings 41, whereby the ring-shaped connection terminals 42 can freely rotate around the ring-shaped shaft bearings 41, and can also elastically deform along the radial direction, as described previously. More specifically, the diameter of the shaft bearing 41 is smaller than the gap between the inner circumference surface of the ring-shaped outside terminal 31 and the outer circumference surface of the ring-shaped inside terminal 21, and also smaller than the internal diameter of the ring-shaped connection terminal 42. Also, the position of the ring-shaped connection terminal 42 with respect to the axial direction of the rotary connector 10 is defined by the inner circumference edge of the ring-shaped outside insulator 36 and the outer circumference edge of the ring-shaped inside insulator 26. While the ring-shaped connection terminals 42 are placed around the three shaft bearings 41, respectively, in the shown example, the ring-shaped connection terminals 42 can be placed around more than three shaft bearings 41. In this case, it is desirable that the ring-shaped connection terminals 42 be placed equangularly.

In the shown example, the same shaft bearings as the shaft bearings 41 placed between the inner circumference surface of the ring-shaped outside terminal 31 and the outer circumference surface of the ring-shaped inside terminal 21 are inserted in the engagement holes 23 of the ring-shaped inside terminal 21. However, rod-like members different from the shaft bearings 41 can be inserted in the engagement holes 23 of the ring-shaped inside terminal 21. Also, in the example, all the shaft bearings 41 placed between the inner circumference surface of the ring-shaped outside terminal 31 and the outer circumference surface of the ring-shaped inside terminal 21 are the same in this example, however, the shaft bearing 41 with no ring-shaped connection terminal 42 around can be a different rod-like member from the shaft bearing 41.

A process of assembling the rotary connector 10 is explained in the following.

Figure 9:
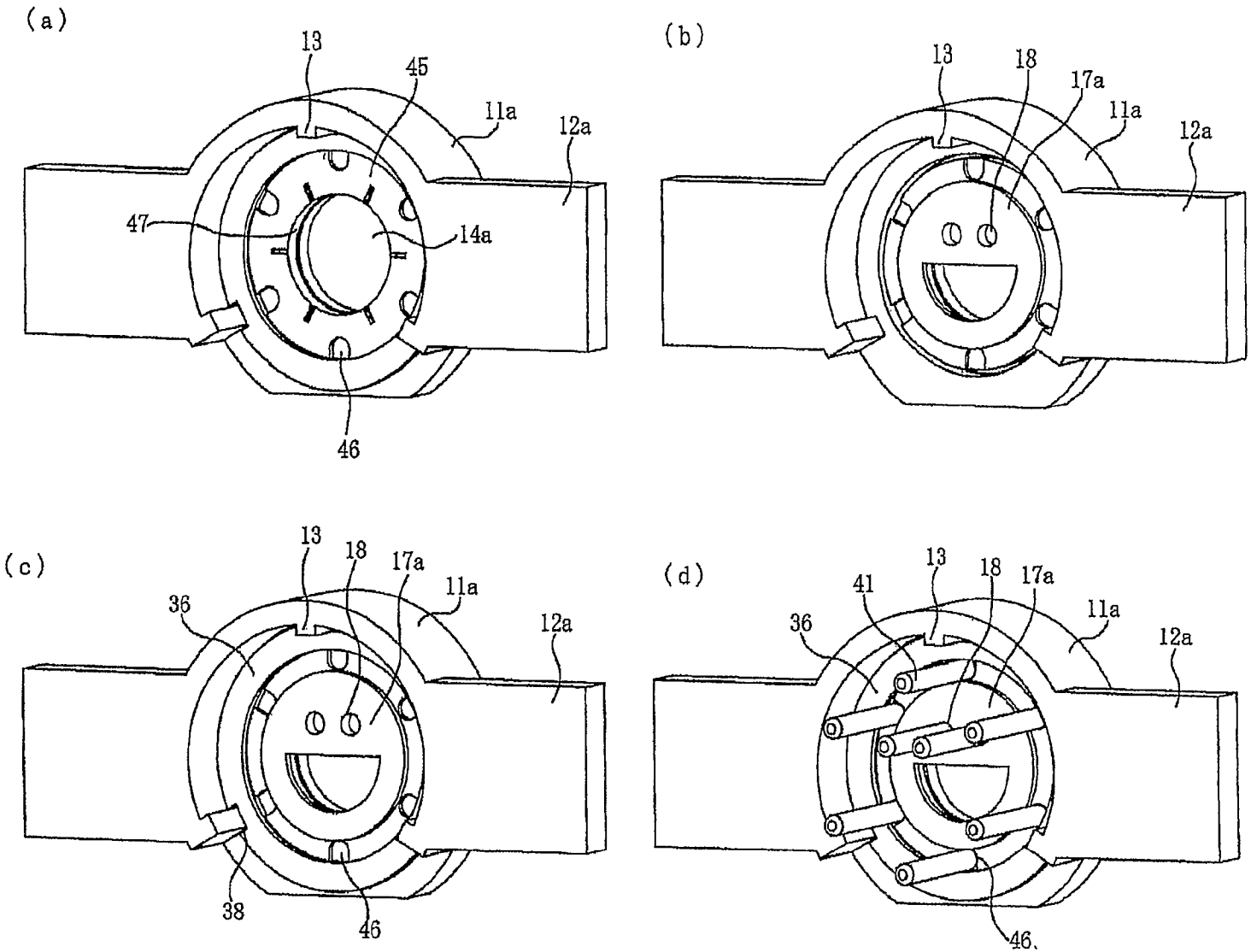
FIG. 9 is a first drawing showing an assembly process of the rotary connecter according to the embodiment of the present invention.
Figure 10:
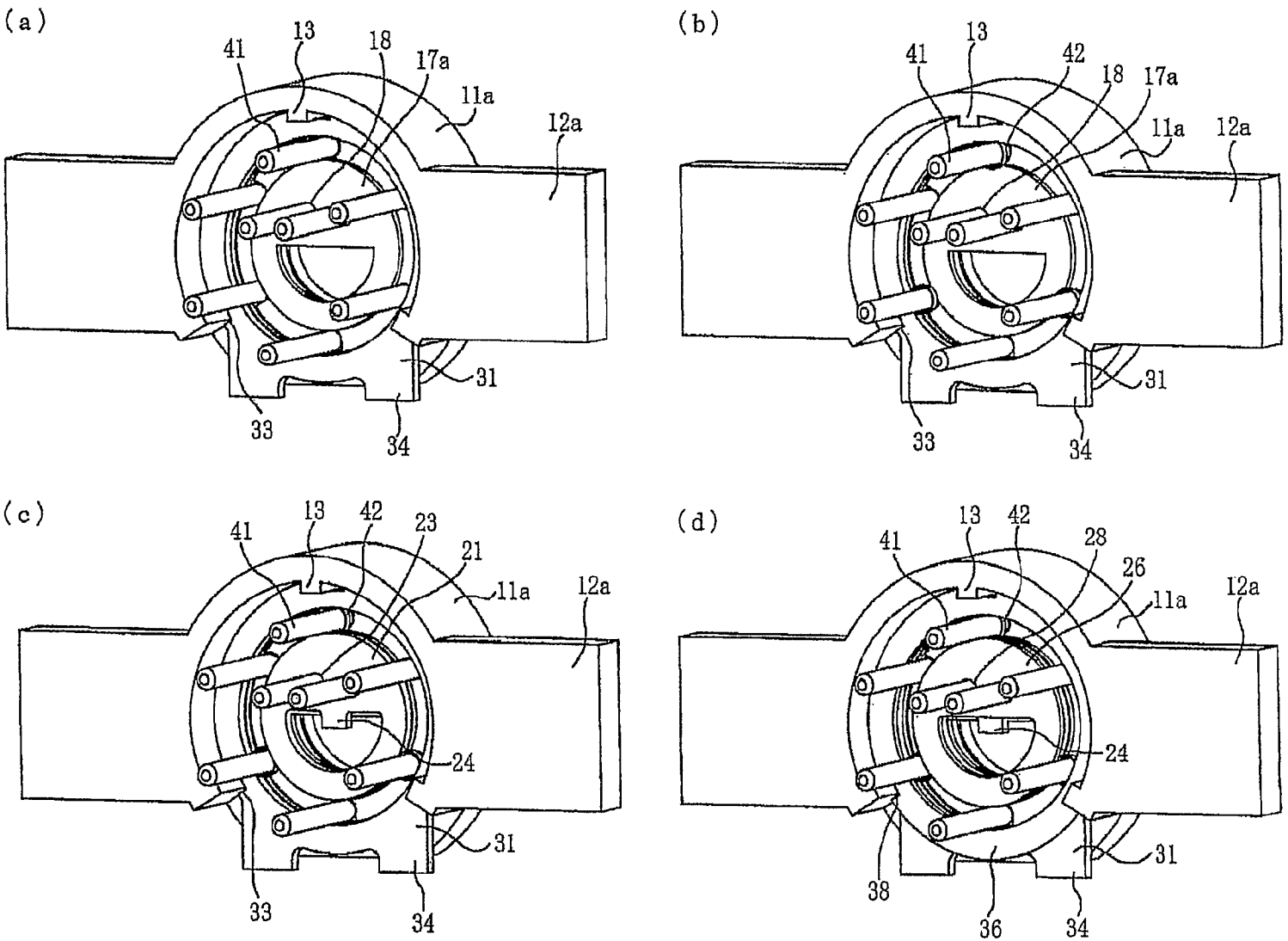
FIG. 10 is a second drawing showing the assembly process of the rotary connecter according to the embodiment of the present invention.
Figure 11:
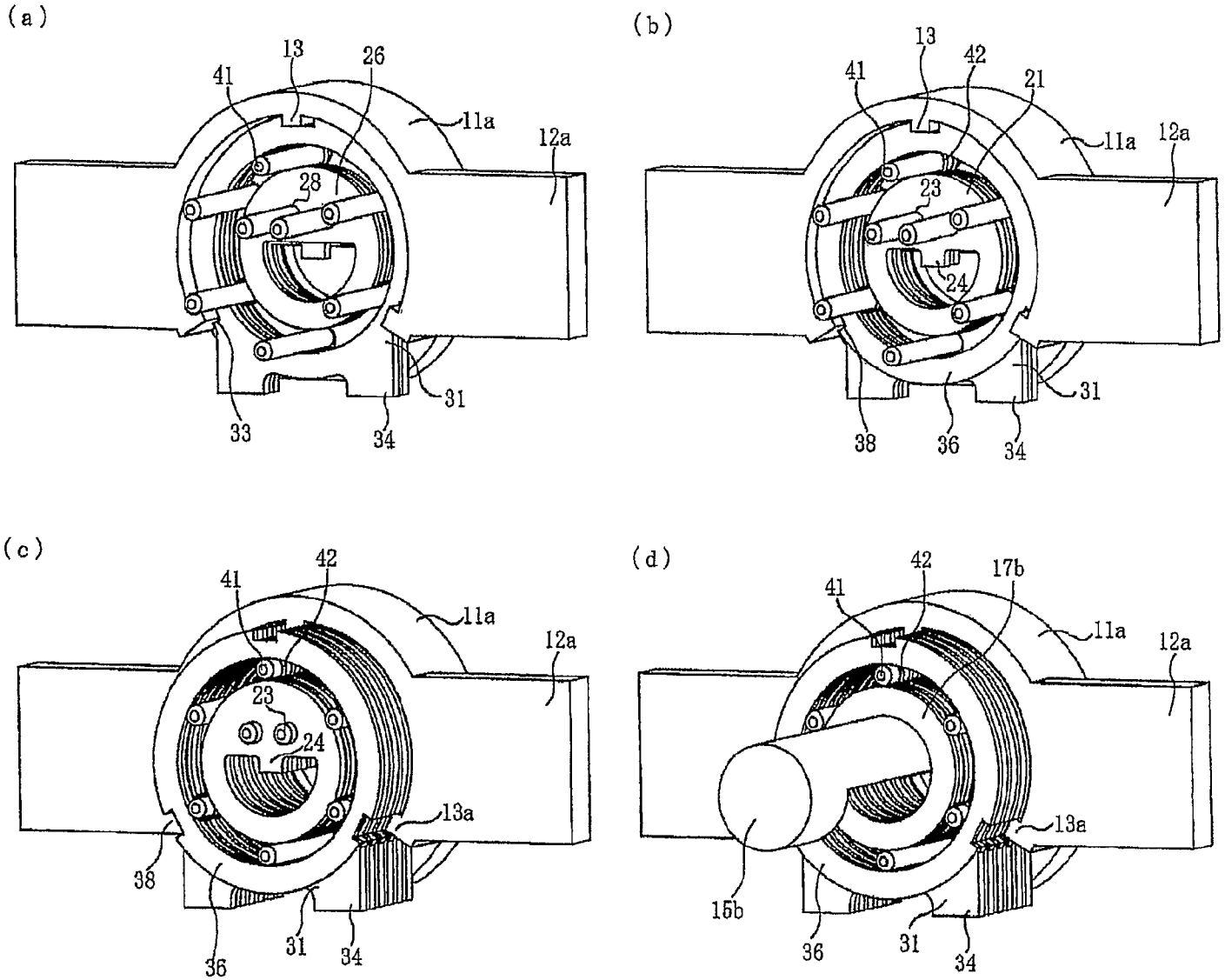
FIG. 11 is a third drawing showing the assembly process of the rotary connecter according to the embodiment of the present invention.

FIG. 9 is a first drawing showing an assembly process of the rotary connector according to the embodiment of the present invention. FIG. 10 is a second drawing showing the assembly process of the rotary connector according to the embodiment of the present invention. FIG. 11 is a third drawing showing the assembly process of the rotary connector according to the embodiment of the present invention.

As shown in FIG. 9A, the bearing sleeve 45 is mounted inside the rear cover 11*a*. The bearing sleeve 45 has a plurality of, for example, six mounting concave portions 46 on the outer circumference portion thereof. The end of each shaft bearing 41 is inserted into each of the mounting concave portions 46, the shaft bearing 41 being placed between the inner circumference surface of the ring-shaped outside terminal 31 and the outer circumference surface of the ring-shaped inside terminal 21. Also the bearing sleeve 45 has a hole 47 of the same size as the opening 14*a* of the rear cover 11*a*.

Subsequently, as shown in FIG. 9B, the rear shaft 15*a* is mounted in the rear cover 11*a*. At this point, the rear flange 17*a* abuts the inside (the front side in FIG. 9) surface of the bearing sleeve 45, and the rear shaft 15*a* is mounted so that the rear shaft 15*a* runs through the hole 47 of the bearing sleeve 45 and the opening 14*a* of the rear cover 11*a* so as to project outwards (the rear side in FIG. 9) from the rear cover 11*a*. Additionally, the rear flange 17*a* has mounting holes 18 for mounting the ends of the shaft bearings 41, which are inserted in the engagement holes 23 of the ring-shaped inside terminal 21.

Subsequently, as shown in FIG. 9C, a first ring-shaped outside insulator 36 is mounted inside the rear cover 11*a*. At this point, the orientation of the ring-shaped outside insulator 36 is adjusted so that the engagement concave portions 38 formed on the outer circumference portion of the ring-shaped outside insulator 36 engage with the engagement convex portions 13 formed on the inner circumference surface of the rear cover 11*a*.

Subsequently, as shown in FIG. 9D, the shaft bearings 41 are mounted inside the rear cover 11*a*. At this point, the ends of the shaft bearings 41 are inserted into the mounting concave portions 46 of the bearing sleeve 45 and the mounting holes 18 of the rear flange 17*a*.

Subsequently, as shown in FIG. 10A, a first ring-shaped outside terminal 31 is mounted inside the rear cover 11*a*. At this point, the ring-shaped outside terminal 31 is superimposed on the ring-shaped outside insulator 36. And also the orientation of the ring-shaped outside terminal 31 is adjusted so that the connection legs 34 formed in the outer circumference portion of the ring-shaped outside terminal 31 project below the bottom of the rear cover 11*a*, and the engagement concave portions 33 engage with the engagement convex portions 13 formed in the inner circumference surface of the rear cover 11*a*.

Subsequently, as shown in FIG. 10B, first ring-shaped connection terminals 42 are mounted. At this point, the ring-shaped connection terminals 42 are placed around three of the shaft bearings 41 and adjusted so as to abut the inner circumference surface of the ring-shaped outside terminal 31.

Subsequently, as shown in FIG. 10C, a first ring-shaped inside terminal 21 is mounted inside the rear cover 11*a*. At this point, the ring-shaped inside terminal 21 is superimposed on the rear flange 17*a*, and the orientation of the ring-shaped inside terminal 21 is adjusted so that the shaft bearings 41, which are placed into the mounting holes 18 of the rear flange 17*a*, are inserted into the engagement holes 23 of the ring-shaped inside terminal 21. Moreover, when the ring-shaped inside terminal 21 is mounted, the ring-shaped connection terminals 42 are adjusted by being elastically deformed so as to be smaller in the radial direction thereof or the like, so that the ring-shaped connection terminals 42 abut the outer circumference surface of the ring-shaped inside terminal 21.

Subsequently, as shown in FIG. 10D, a second ring-shaped outer insulator 36 and a first ring-shaped inside insulator 26 are mounted. At this point, the ring-shaped outside insulator 36 is superimposed on the ring-shaped outside terminal 31, but for the rest, it is mounted in the same manner as the process shown in FIG. 9C. On the other hand, the ring-shaped inside insulator 26 is superimposed on the ring-shaped inside terminal 21, and the orientation of the ring-shaped inside insulator 26 is adjusted so that the shaft bearings 41, which are placed into the mounting holes 18 of the rear flange 17*a*, are inserted into the engagement holes 28 of the ring-shaped inside insulator 26.

Subsequently, as shown in FIG. 11A, a second ring-shaped outside terminal 31 is mounted inside the rear cover 11*a*. In this instance, the ring-shaped outside terminal 31 is mounted in the same manner as the process shown in FIG. 10A.

Subsequently, as shown in FIG. 11B, second ring-shaped connection terminals 42 are placed around the shaft bearings 41, and a second ring-shaped inside terminal 21 and a third ring-shaped outside insulator 36 are mounted inside the rear cover 11*a*. In this instance, the ring-shaped connection terminals 42, the ring-shaped inside terminal 21, and the ring-shaped outside insulator 36 are mounted in the same manner as the process shown in FIG. 10B to 10D.

Subsequently, as shown in FIG. 11C, a predetermined number of the ring-shaped outside terminals 31 and the ring-shaped outside insulators 36 are mounted in a state of being alternately superimposed on each other, and also a predetermined number of the ring-shaped inside terminals 21 and the ring-shaped inside insulators 26 are mounted in a state of being alternately superimposed on each other, by repeating the processes shown in FIGS. 11A and 11B. Furthermore, a predetermined number of the ring-shaped connection terminals 42 are mounted between the ring-shaped outside terminals 31 and the ring-shaped inside terminals 21, which are placed to face each other.

Subsequently, the front shaft 15*b* is mounted as shown in FIG. 11D. In this situation, the front flange 17*b* abuts the ring-shaped inside terminal 21, and the ends of the shaft bearings 41, which are inserted into the engagement holes 23 of the ring-shaped inside terminal 21, are mounted in the mounting holes 18, which is not shown.

Finally, the front cover 11*b* is mounted and thereby the rotary connecter 10 as shown in FIG. 2 can be obtained.

As described hereinabove, in this embodiment, the rotary connector 10 includes a ring-shaped outside terminal 31 having a circular inner circumference portion and connected to the wire of one connection target member, a ring-shaped inside terminal 21 having a circular outer circumference portion, which is concentric with the inner circumference portion of the ring-shaped outside terminal 31, and connected to the wire of the other connection target member, and a rotatable ring-shaped connection terminal 42 electrically connecting the ring-shaped outside terminal 31 and the ring-shaped inside terminal 21, wherein the ring-shaped connection terminal 42 elastically deforms along a radial direction thereof, and an outer circumference portion of the ring-shaped connection terminal 42 abuts the inner circumference portion of the ring-shaped outside terminal 31 and the outer circumference portion of the ring-shaped inside terminal 21. Therefore, even if there are manufacturing or assembling errors in members of the rotary connector 10, the errors can be absorbed and therefore no electrical disconnection occurs, even if momentarily, between the ring-shaped inside terminal 21 and the ring-shaped outside terminal 31 through the ring-shaped connection terminals 42. Thereby, it is possible to achieve a simply-structured, low-cost, and widely applicable rotary connector, which is highly reliable in electrical connection.

Further the ring-shaped connection terminal 42 rolls around the inner circumference of the ring-shaped outside terminal 31 and the outer circumference of the ring-shaped inside terminal 21 while elastically deforming along the radial direction of the ring-shaped connection terminal 42, when the ring-shaped outside terminal 31 and the ring-shaped inside terminal 21 relatively rotate. Therefore, the ring-shaped connection terminal 42 not only absorbs errors by elastically deforming so as to reliably maintain the electrical connection between the ring-shaped inside terminal 21 and the ring-shaped outside terminal 31, but can reduce the resistance since the ring-shaped inside terminal 21 does not slidingly contact the ring-shaped outside terminal 31. Furthermore, since the ring-shaped connection terminals 42 do not slidingly contact the ring-shaped inside terminal 21 and the ring-shaped outside terminal 31, the ring-shaped inside terminal 21 and the ring-shaped outside terminal 31 do not wear out.

Further, the ring-shaped connection terminal 42 is mounted rotatably around a shaft bearing 41 extending parallel to an axis of the ring-shaped outside terminal 31 and the ring-shaped inside terminal 21 and mounted so as to be elastically deformable along the radial direction of the ring-shaped connection terminal 42. Moreover, the ring-shaped connection terminal 42 is positioned by a ring-shaped inside insulator 26 and a ring-shaped outside insulator 36 along the axial direction. Therefore, it is possible to maintain the ring-shaped connection terminal 42 with a simple structure, to simplify the structure of the rotary connector 10, and to reduce the cost.

In the embodiment described above, a ring-shaped outside insulator 36 is inserted between each pair of ring-shaped outside terminals 31, and a ring-shaped inside insulator 26 between each pair of ring-shaped inside terminals 21, so as to restrict movement of the ring-shaped connection terminals 42 along the axial direction. The ring-shaped outside insulator 36 and the ring-shaped inside insulator 26 are used to form an annular space therebetween so as to allow the ring-shaped connection terminal 42 mounted on the shaft bearing 41 to roll around the ring-shaped inside terminal 21 while maintaining the relative locations of the ring-shaped connection terminals 42.

Thus the ring-shaped connection terminal 42 rolls around the ring-shaped inside terminal 21, thereby reducing loss of rotation caused by the ring-shaped connection terminal 42 sliding on the outer circumference of the ring-shaped inside terminal 21 and the inner circumference of the ring-shaped outside terminal 31.

Figure 12:
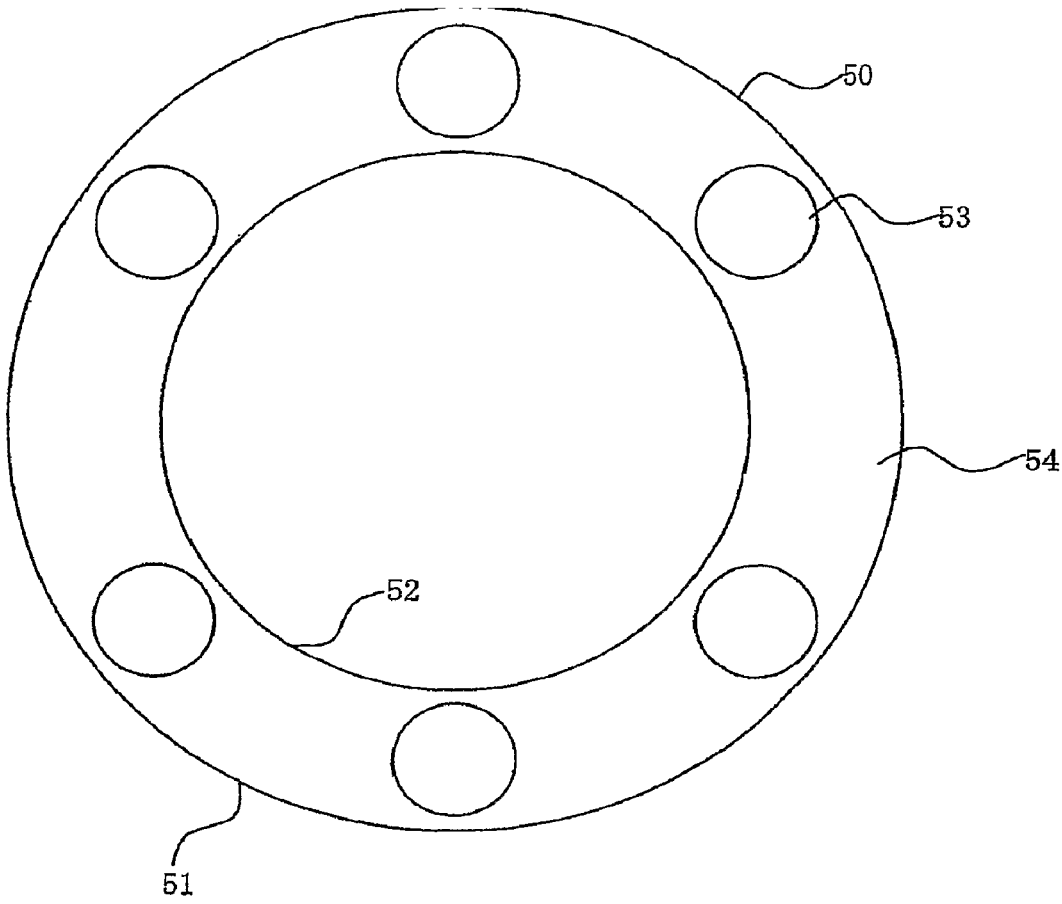
FIG. 12 is a plan view showing an example of an alternative form of the ring-shaped insulator.
Figure 13:
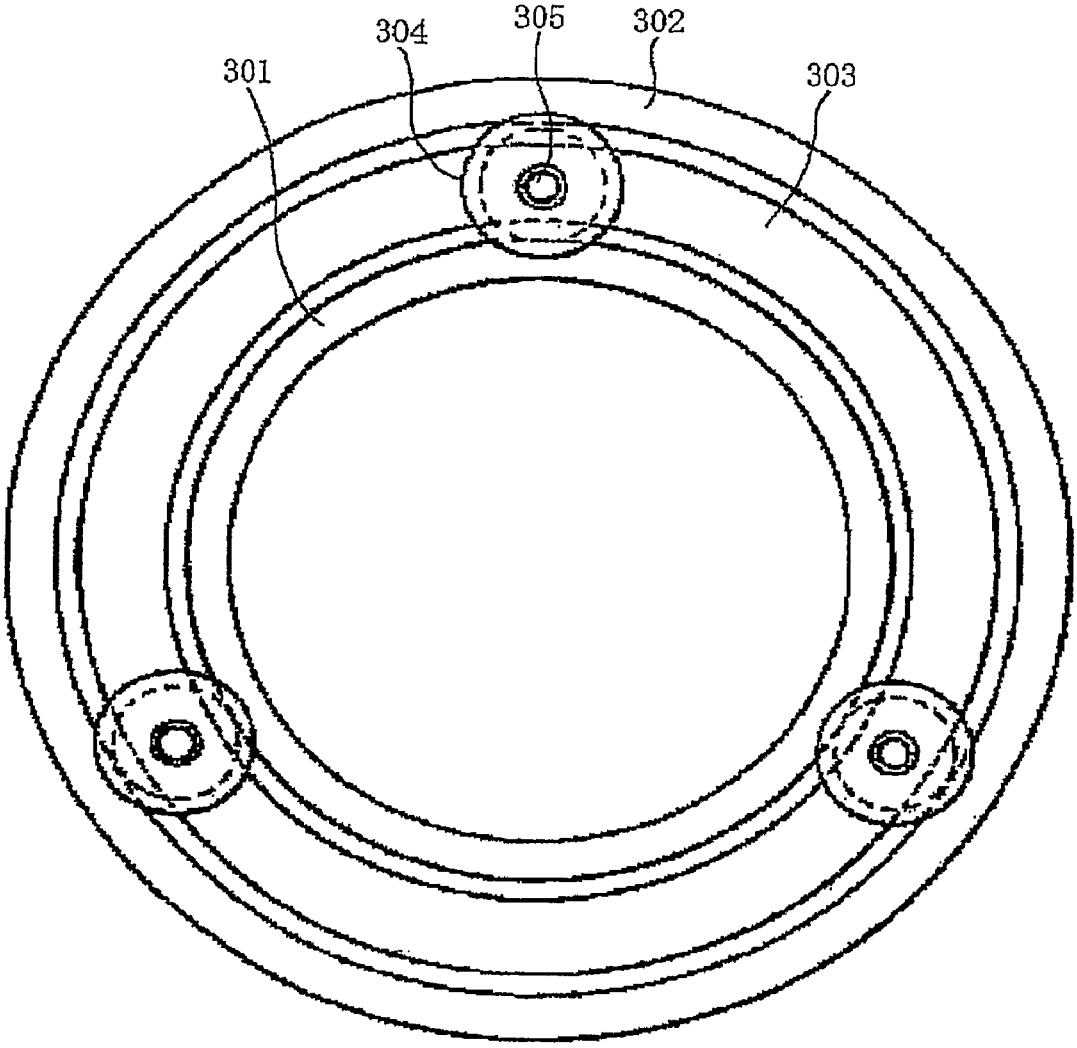
FIG. 13 is a plan view of the main part of a conventional rotary connector.

An insulator with a structure shown in FIG. 12 can also be used for this purpose.

FIG. 12 is a plan view showing an example of an alternative form of the ring-shaped insulator.

The ring-shaped insulator 50 shown in FIG. 12 is assumed to be sized such that the radius of the outer circumference 51 thereof is larger than the radius of the inner circumference of the ring-shaped outside terminal 31 without contacting the engagement convex portion 13 and such that the radius of the inner circumference 52 is smaller than the radius of the outer circumference of the ring-shaped inside terminal 21 without abutting the shaft bearings 41 mounted on the ring-shaped inside terminal 21 and a circuit substrate housed inside the hole 22.

Holes 53 for inserting the shaft bearings 41 are provided in the annular part 54 so as to match the locations of the shaft bearings 41.

The diameter of each hole 53 is almost the same as the size of the shaft bearing 41. The hole 53 is large enough for the shaft bearing 41 to pass through it, and also smaller than the outer diameter of the ring-shaped connection terminal 42. Thereby, the end of the ring-shaped connection terminal 42 is supported on the surface of the annular part 54.

The ring-shaped insulator 50 serves as an insulator for insulating each of the connection terminals superimposed on each other, and it can be used as a retainer of the shaft bearings 41, that is, as a retainer used when the ring-shaped connection terminals 42 roll around the ring-shaped inside terminal 21. Thereby, the number of members used as insulators can be reduced.

It should be noted here that the present invention is not limited to the above embodiment, but can be variously modified and changed within the gist of the invention. Thus the modifications and changes are not excluded from the scope of the present invention.

What is claimed is:

1. A rotary connector for electrically connecting wires of two relatively rotating connection target members, comprising:

(a) a ring-shaped outside terminal having a circular inner circumference portion and connected to the wire of one connection target member;

(b) a ring-shaped inside terminal having a circular outer circumference portion, which is concentric with the inner circumference portion of the ring-shaped outside terminal, and connected to the wire of the other connection target member; and (c) a rotatable ring-shaped connection terminal electrically connecting the ring-shaped outside terminal and the ring-shaped inside terminal, and the ring-shaped connection terminal is positioned along the axial direction by insulators alternately superimposed on the ring shaped outside terminal and the ring-shaped inside terminal; wherein (d) the ring-shaped connection terminal elastically deforms along a radial direction thereof, and an outer circumference portion of the ring-shaped connection terminal abuts the inner circumference portion of the ring-shaped outside terminal and the outer circumference portion of the ring-shaped inside terminal.

2. The rotary connector according to claim 1, wherein the ring-shaped connection terminal rolls around the inner circumference portion of the ring-shaped outside terminal and the outer circumference portion of the ring-shaped inside terminal while elastically deforming along the radial direction of the ring-shaped connection terminal, when the ring-shaped outside terminal and the ring-shaped inside terminal relatively rotate.

3. The rotary connector according to claim 1, wherein the ring-shaped connection terminal is mounted rotatably around a rod-like bearing member extending parallel to an axis of the ring-shaped outside terminal and the ring-shaped inside terminal and so as to be elastically deformable along the radial direction of the ring-shaped connection terminal.

4. The rotary connector according to claim 1, wherein (a) the ring-shaped outside terminal is superimposed alternately on the ring-shaped outside insulator having an inner circumference portion smaller in diameter than the inner circumference portion of the ring-shaped outside terminal;

(b) the ring-shaped inside terminal is superimposed alternately on the ring-shaped inside insulator having an outer circumference portion larger in diameter than the outer circumference portion of the ring-shaped inside terminal; and (c) the ring-shaped connection terminal is positioned along the axial direction by the ring-shaped outside insulator and the ring-shaped inside insulator.

5. The rotary connector according to claim 1, wherein (a) the ring-shaped outside terminal and the ring-shaped inside terminal are superimposed alternately on the ring-shaped intermediate insulator having an outer circumference portion larger in diameter than the inner circumference portion of the ring-shaped outside terminal, an inner circumference portion smaller in diameter than the outer circumference portion of the ring-shaped inside terminal, and openings for inserting the rod-like bearing members; and (b) the ring-shaped connection terminal is supported by an edge of the opening, and positioned by the ring-shaped intermediate insulator along the axial direction.

* * * * *